US008616824B2

(12) United States Patent
Trebbi et al.

(10) Patent No.: US 8,616,824 B2
(45) Date of Patent: Dec. 31, 2013

(54) APPARATUS FOR TRANSFERRING AND MOVING ELEMENTS OF A WORKING MACHINE

(75) Inventors: Claudio Trebbi, Medicina (IT); Alessandro Bisi, Argelato (IT); Francesco Sanmartin, Cornedo Vicentino (IT)

(73) Assignee: IMA Life S.R.L., Ozzano dell-Emilia (Bologna) (IT)

( * ) Notice: Subject to any disclaimer, the term of this patent is extended or adjusted under 35 U.S.C. 154(b) by 921 days.

(21) Appl. No.: 12/296,165

(22) PCT Filed: Apr. 4, 2007

(86) PCT No.: PCT/IB2007/000885
§ 371 (c)(1),
(2), (4) Date: Dec. 30, 2008

(87) PCT Pub. No.: WO2007/113660
PCT Pub. Date: Oct. 11, 2007

(65) Prior Publication Data

US 2009/0202332 A1 Aug. 13, 2009

(30) Foreign Application Priority Data

Apr. 5, 2006 (IT) ..... BO06A0245

(51) Int. Cl.
*B65G 1/00* (2006.01)

(52) U.S. Cl.
USPC ..... 414/331.06; 414/222.07; 414/226.04

(58) Field of Classification Search
USPC ..... 414/572, 331.06, 331.1, 332, 222.07, 414/222.08, 222.13, 225.01, 226.01, 414/226.02, 226.04
See application file for complete search history.

(56) References Cited

U.S. PATENT DOCUMENTS

| | | | | | |
|---|---|---|---|---|---|
| 5,364,219 | A * | 11/1994 | Takahashi et al. | ..... | 414/217 |
| 5,622,470 | A * | 4/1997 | Schaefer et al. | ..... | 414/807 |
| 6,089,812 | A * | 7/2000 | Junker | ..... | 414/401 |
| 6,138,721 | A * | 10/2000 | Bonora et al. | ..... | 141/98 |
| 6,524,052 | B1 * | 2/2003 | Yamauchi et al. | ..... | 414/331.1 |
| 2003/0044261 | A1 * | 3/2003 | Bonora et al. | ..... | 414/217.1 |
| 2004/0052624 | A1 * | 3/2004 | Miyano et al. | ..... | 414/498 |
| 2006/0099055 | A1 | 5/2006 | Stefani | | |

FOREIGN PATENT DOCUMENTS

| | | |
|---|---|---|
| CN | 1749131 | 3/2006 |
| EP | 0 858 948 | 8/1998 |
| EP | 1 598 275 | 11/2005 |
| WO | 92/12864 | 8/1992 |

OTHER PUBLICATIONS

International Search Report for PCT/IB2007/000885, mailed Feb. 14, 2008.
Chinese Office Action dated Mar. 26, 2012 issued in Chinese Patent Application No. 201110038517.6, 7 pp.

* cited by examiner

*Primary Examiner* — Jonathan Snelting
(74) *Attorney, Agent, or Firm* — Nixon & Vanderhye P.C.

(57) ABSTRACT

An apparatus for transferring and moving elements that are removably associable with an operating machine comprises a moving arrangement suitable for receiving and supporting the elements, the moving arrangement being movable for transferring to and/or removing from the operating machine the elements; the operating machine comprises a supporting arrangement configured for receiving from and giving to the apparatus the elements, the supporting arrangement in turn comprising hooking elements suitable for abutting and locking abutting elements of the elements.

36 Claims, 8 Drawing Sheets

1
10
28
29
A
9
46
2
16
20
X
45
64
51
Z
40
50
2A
2B
67
61
48
60
24
68
54
48
21
3
72
73
25
41
13
26
19

1
2A
D
21
13c
13a
A
20
X
62
60
E
41b
61
41a
85
13a
41
37
36
4
17
50
31
32
53
30
18
34

APPARATUS FOR TRANSFERRING AND MOVING ELEMENTS OF A WORKING MACHINE

CROSS-REFERENCE TO RELATED APPLICATIONS

This application is the U.S. national phase of International Application No. PCT/IB2007/000885, filed 4 Apr. 2007, which designated the U.S. and claims priority to Italy Application No. B02006A000245, filed 5 Apr. 2006, the entire contents of each application is hereby incorporated by reference.

DESCRIPTION

The present invention relates to an apparatus for transferring and moving elements associable with an operating machine, in particular transferring and/or removing elements such as parts, components and operating units of an automatic packaging machine.

The invention further relates to an operating machine suitable for receiving and transferring elements that are associable therewith by means of the aforesaid transferring and moving apparatus.

In the pharmaceutical and biotechnological industries there is often a requirement for product packaging processes to use sterile materials and in sterile environments in order to prevent the products from suffering particle and bacteriological contamination, i.e. contamination due to the presence in the air of solid suspended particles such as ashes, powder, spores, microorganisms.

For this purpose, the production systems comprise packaging machines or lines inserted inside cleanrooms, which separate an internal processing environment, in fact a sterile processing environment, from a surrounding non-sterile external environment, or environment having a different class of sterility or contamination.

The degree of contamination of an environment is defined by the number of polluting particles present in a volume of air unit. Standard tables define contamination classes for each of which there is defined the maximum permissible number of polluting particles of the indicated dimension per cubic foot (US FED STD 209 Cleanroom standards) or per cubic metre of air (ISO 14644-1 Cleanroom standards).

The contamination class required in the process environment is obviously a function of the product to be packaged. For example, for pharmaceutical products to be administered parenterally or nasally, or ophthalmic products packaging in a class ISO 5 (ISO 14644-1) or class 100 (US FED STD 209) environment is required.

The separation and insulation between the two environments in some applications also aims to prevent the dispersal into the outside environment of products that are potentially toxic and harmful to human health.

The asepsis and/or sterility of the processing environment is ensured by the cleanliness and sterility of each component and element contained inside the cleanroom, and by the presence of a suitable one-way flow of sterile air filtered by suitable high efficiency particulate air (HEPA) filters. The one-way air flow consists of jets of sterile air that move in the same direction almost parallel to one another, at substantially the same speed, in such a way as to create an homogeneous air current without turbulence. The air flow descending from top to bottom forms a front of sterile air that drags away any contaminating particles present and prevents them from rising again from the bottom of the chamber.

Inside the cleanroom there is provided the entrance for the operators assigned to perform a plurality of interventions on the packaging machines, such as, for example, adjustments, assembly and dismantling of parts, operating units, etc., interventions that in all cases must not connect the sterile processing environment with non-sterile zones of the machine such as spaces containing mechanisms and kinematic mechanisms.

The aim is, in fact, to perform operations and interventions on the machine without compromising the sterility of the sterile environment, in order to avoid procedures of restoring sterility that are laborious, long and very costly.

For this purpose, in order to avoid the contamination of the sterile environment, and the parts and components with which they come into contact, the operators have to wear suitable protective overalls that cover all parts of their body.

In order to sterile appropriately any object to be introduced into the cleanroom, there is provided an autoclave, provided with two hatches, which are respectively in communication with the non-sterile external environment and with the cleanroom, in such a way as to prevent a direct connection between the latter.

In this way the operator is able to introduce inside the cleanroom elements to be mounted onto the machine, usually standard parts and components and/or operating units and devices, for example product dosing units, to be replaced at the end of production.

These elements are transferred manually by one or more operators from the autoclave to the machine on which they are mounted.

Recently however, the need has arisen to limit the intervention by operators to prevent them interacting directly with parts intended to come into contact with the product to be packaged, such as, for example, dosing devices, components for introducing and supplying the product.

In fact, it has been observed that although operators are provided with protective gloves and overalls, they constitute a potential source of particle contamination. The close proximity and the contact of said operators with sterile objects may cause the latter to be contaminated.

This possible and potential contamination may be considered to be unacceptable in certain packaging processes.

Currently, after each operation and/or direct intervention by the operators on parts intended to come into contact with the product, it is necessary to proceed with the subsequent sterilisation of the latter, with a consequent increase in the cost and time required to set up the packaging machine for production.

At the end of production it is generally necessary to dismantle the components of the machine that have come into contact with the product or have a size that is not compatible with the next production batch. These elements have to be transferred outside the clean room to be cleaned, washed and then sterilised, i.e. have to be made suitable for subsequent use.

The transfer outside the cleanroom occurs through a communicating chamber provided, similarly to the autoclave, with a first door giving access to the cleanroom and with a second door giving access to the non-sterile external environment. In this way the operators in the cleanroom transfer the elements dismantled from the machine to the chamber from which, after the first door has been closed hermetically, other operators remove them to subject them to washing and sterilising operations.

These manual procedures nevertheless have the drawback of forcing the operators to touch and handle parts and components of the machine on which the packaged product is present in varying quantities. This direct, prolonged and repeated contact with pharmaceuticals should be avoided as it exposes the operators to the possible absorption of unspecified quantities of product that may harm the health or cause health diseases of varying gravity. This is particularly true in the case of products in the form of fine powders, which can be easily diffused in the air and thus be inhaled and/or absorbed by the operators.

In order to overcome this problem it is currently necessary to limit the operating time of each operator, i.e. the time during which the latter is in contact with parts and components affected by the product. This is achieved through a frequent turnover of operators, which requires an appropriate number of operators to be made available and prepared for operations inside the cleanroom, with a consequent increase in system running costs.

Alternatively, it is necessary to provide the operators with particular equipment, such as completely airtight overalls and masks that are able to insulate the operators completely from the surrounding environment. In addition to being very costly, this equipment places significant limitations on movements and performable manual operations.

An object of the present invention is to obtain an apparatus that is able to transfer and move elements that are associable with an operating machine, such as parts, components and operating units, without requiring a direct manual intervention by operators on said elements.

Another object is to obtain an apparatus that enables elements from an operating machine to be assembled and/or dismantled automatically.

A further object is to obtain an apparatus that enables the elements to be transferred to be kept separately and substantially insulated and to be moved from the surrounding environment in particular by operators operating or near said apparatus.

A still further object is to obtain an apparatus arranged for operating within a controlled environment atmosphere.

Still another object is to obtain an operating machine suitable for cooperating with said apparatus for receiving from and giving to the latter elements such as parts, components and operating units.

A further object is to obtain an operating machine that enables operating elements such as operating units and devices to be assembled and dismantled completely. In a first aspect of the invention there is provided an apparatus for transferring and moving elements that are removably associable with an operating machine comprising a moving arrangement that is suitable for receiving and supporting said elements, said moving arrangement being movable for transferring to and/or removing from said operating machine said elements.

Owing to this aspect of the invention it is possible to obtain an apparatus that enables transferring and moving of elements such as parts, components and operating units that are associable with an operating machine, without requiring direct manual intervention by operators.

In particular, the apparatus enables a plurality of several elements to be assembled automatically on the operating machine or to be dismantled therefrom without the operators coming into direct contact with the elements.

The apparatus, being provided with a containing element that encloses the moving arrangement and the elements to be transferred and moved, further enables to keep said elements separate and substantially insulated from the surrounding environment and in particular from the operators operating on or near said apparatus.

This is particular advantageous if the machine is a packaging machine placed inside a processing chamber for packaging products in an aseptic and sterile atmosphere. In this case the operator has to be prevented from coming into direct contact with both sterile elements to be installed on the machine, and with elements soiled with product to be dismantled from the machine at the end of production.

In the first case the apparatus enables the elements to be maintained at the same level of sterility (contamination class) that they possess exiting from a sterilising autoclave.

In the second case the apparatus preserves the operators from contact with the product and prevents possible absorption of unspecified quantities of said product, that may harm the health of or cause health diseases in operators.

The apparatus further enables the soiled elements to be positioned on a washing operating machine to perform the cleaning and automatic washing thereof, without the need for manual intervention by operators.

In a second aspect of the invention there is provided an operating machine suitable for cooperating with the apparatus for transferring and moving according to the first aspect of the invention, comprising a supporting arrangement suitable for receiving and supporting respective elements, wherein said supporting arrangement is configured for receiving from and giving said elements to said apparatus, said supporting arrangement comprising hooking elements suitable for abutting and locking abutting elements of said elements.

Owing to this aspect of the invention it is possible to obtain an operating machine that is able to receive from and give to said apparatus elements such as parts, components and operating units. In particular, said machine, as it comprises a supporting arrangement provided with a hooking element, enables said elements to be assembled and connected rapidly and automatically to operating circuits of the machine, without manual intervention by operators. In particular, the operating machine may be a packaging machine and comprise devices for connecting the elements to supply circuits and/or to kinematic mechanisms and to moving mechanisms of said machine.

The operating machine can also be a washing machine and comprise an arrangement for delivering cleaning and washing fluids inside said elements.

The invention can be better understood and implemented with reference to the attached drawings, which illustrate a preferred embodiment by way of non-limiting example, in which.

With reference to the attached FIGS. 1 to 9, 1 generally indicates an apparatus for transferring and moving elements 50, 60, 70 associable with an operating machine consisting, for example, in an automatic packaging machine 4 (FIGS. 5 and 7), operating within a controlled-atmosphere processing chamber, or in a washing machine 5 (FIG. 9), operating in a service room adjacent to and communicating with the aforesaid processing chamber.

The elements 50, 60, 70 consist of parts, components, operating units and devices of said packaging machine 4, which is for example a dosing/capping machine suitable for dosing a pharmaceutical product inside containers (not shown) and capping the latter.

Figure 1:
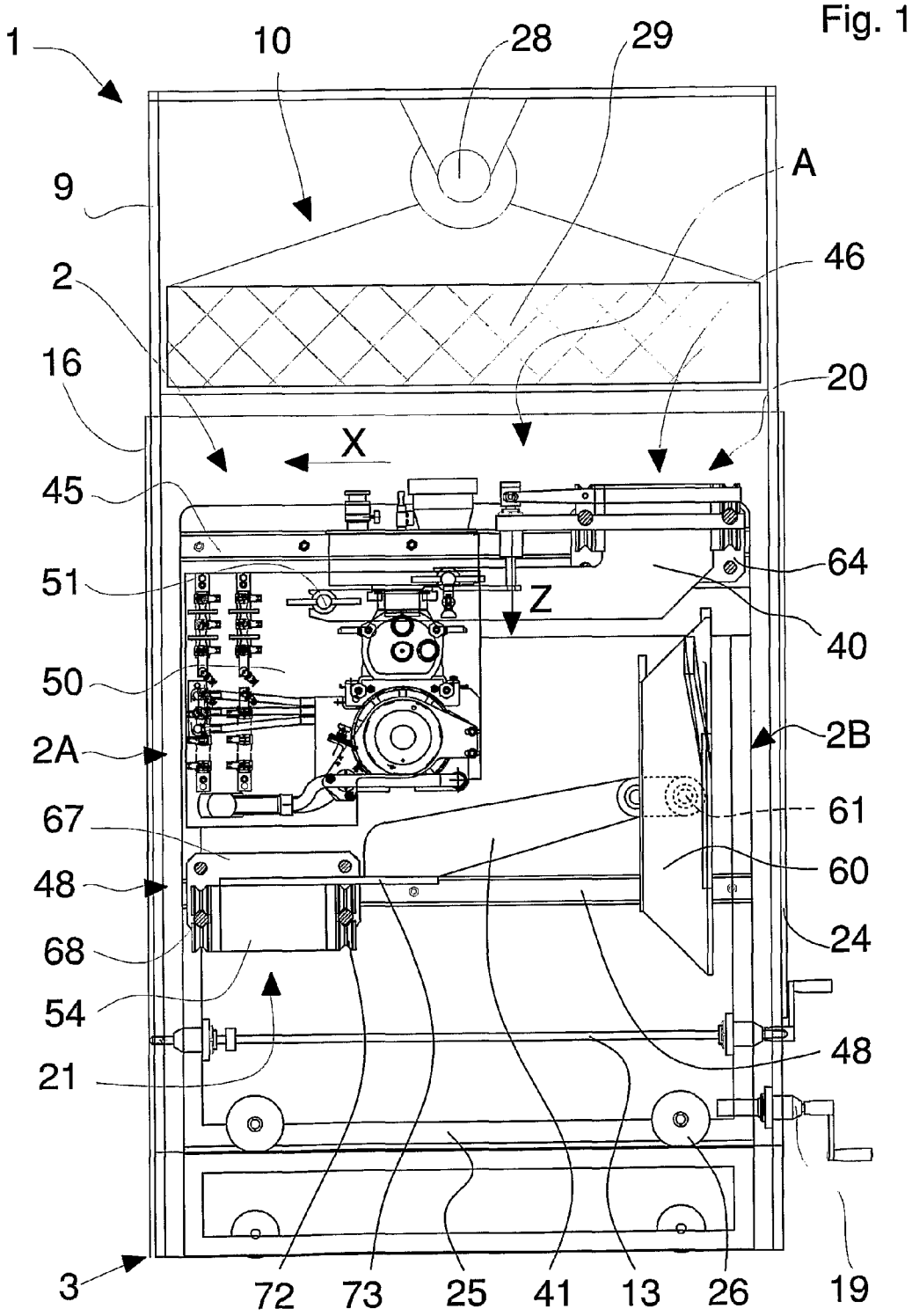
FIG. 1 is a schematic and fragmentary longitudinal section of an apparatus for transferring and moving elements according to the invention, in association with a first and a second element.
Figure 2:
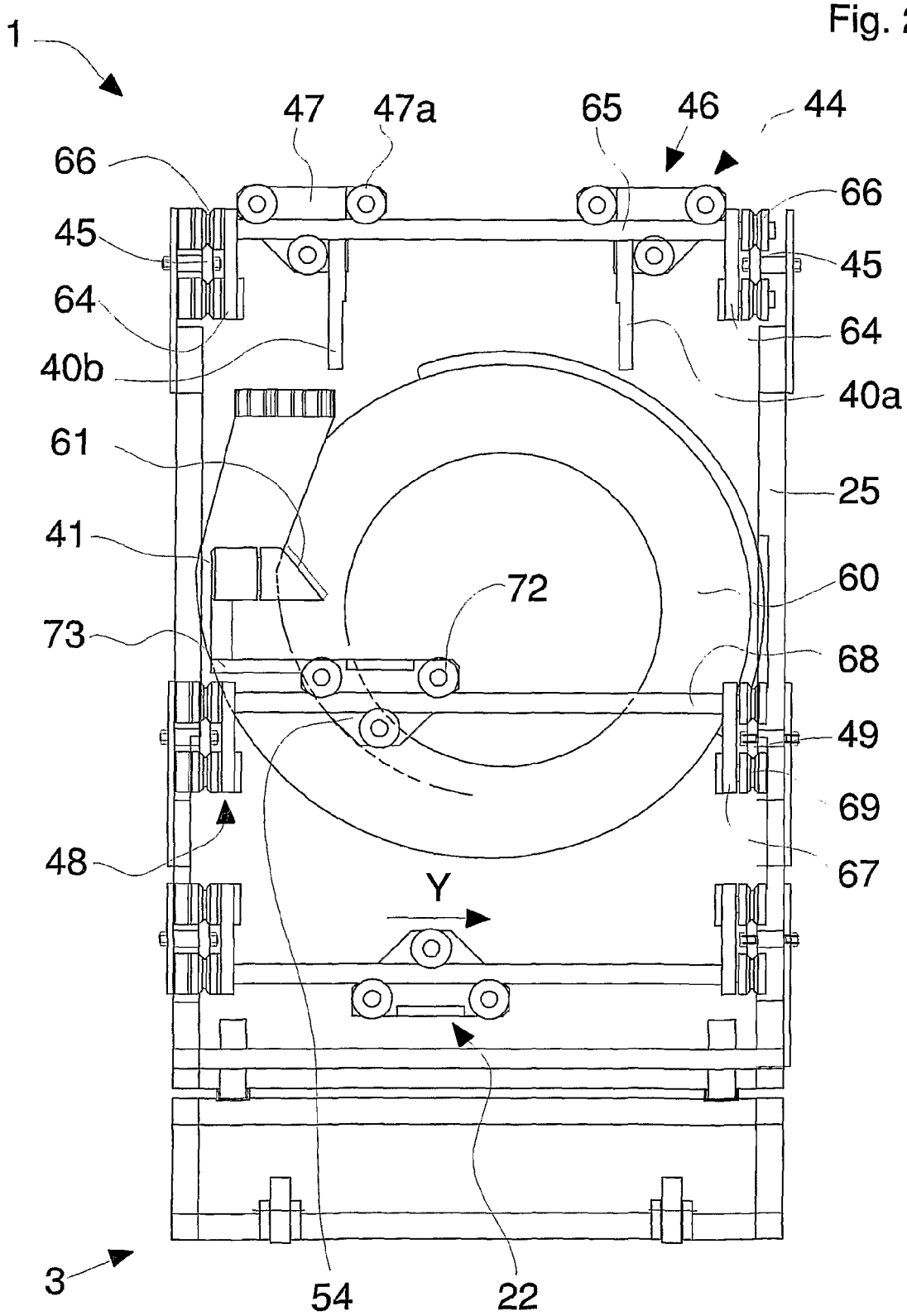
FIG. 2 is a fragmentary rear view of the apparatus in FIG. 1, in which for the sake of clarity the first element has not been shown.
Figure 4:
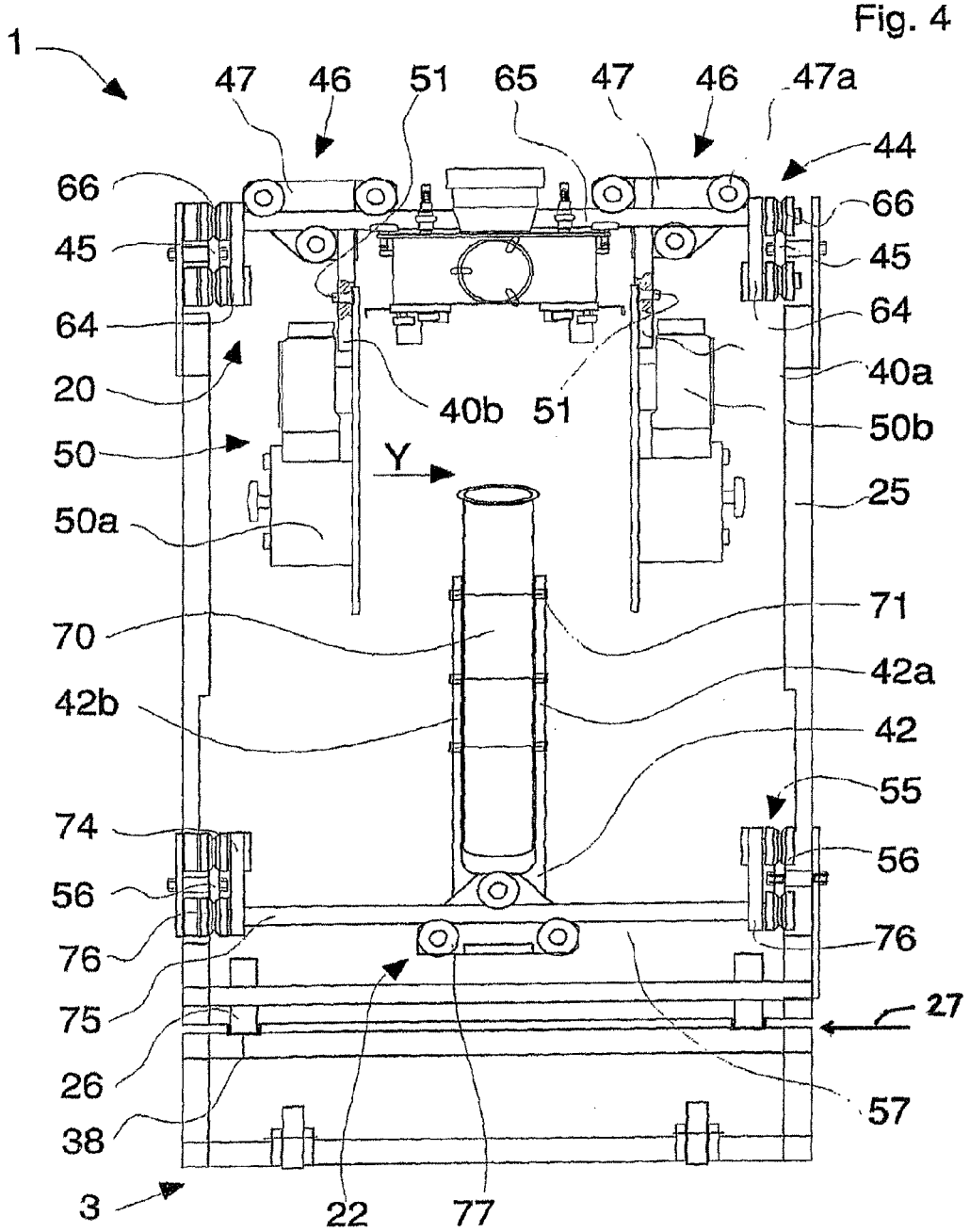
FIG. 4 is a fragmentary rear view of the apparatus in FIG. 3.

As better illustrated in FIG. 4 and in FIGS. 1 and 2, the apparatus 1 may contain and convey simultaneously a first element 50, consisting for example of a dosing unit consisting of two separate parts 50A, 50B that are substantially the same and specular with respect to a longitudinal plane of symmetry, and a second element 60, consisting for example of a vibrating supply device for caps for closing containers.

Figure 3:
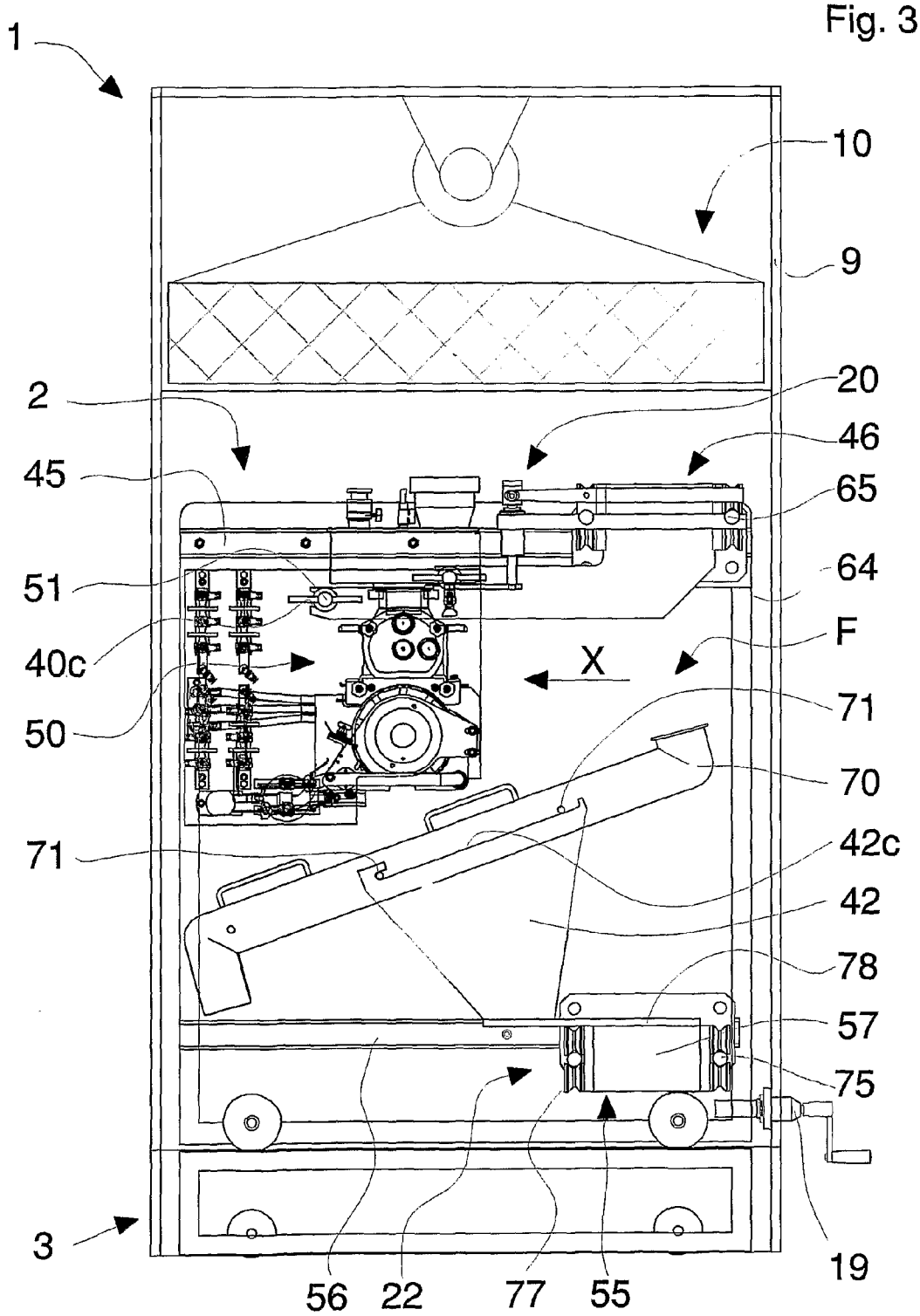
FIG. 3 is a schematic and fragmentary longitudinal section of the apparatus in FIG. 1, in association with a first and a third element.

The apparatus 1 in addition to the operating unit 50, may further contain and convey elements 70 intended to supply the product to be packaged in the packaging machine 4, for example a supply pipe 70 (FIGS. 3 and 4).

According to what has been shown in FIGS. 1, 2 and 3, the apparatus 1 comprises a first trolley 2 provided with a moving arrangement 20, 21, 22 suitable for receiving and supporting the elements 50, 60, 70 and movable for transferring to the operating machine 4 and/or removing from said machine 4 said elements 50, 60, 70.

The moving arrangement 20, 21, 22 comprises respective gripping arrangement 40, 41, 42 suitable for hooking or engaging respective supporting portions 51, 61, 71 of said elements 50, 60, 70.

The first trolley 2 comprises a supporting frame 25 provided with supporting and moving wheels 26.

The supporting frame 25 comprises a plurality of elongated elements, for example square tubular profiles, connected together to form a substantially parallelepipedon-shaped structure suitable for slidably supporting the moving arrangement 20, 21, 22. The latter are in fact movable between respective internal positions, in which said moving arrangement 20, 21, 22 is entirely contained inside the apparatus 1, i.e. inside the first trolley 2, and respective external positions in which they partially protrude outwards, for example for removing and/or transferring elements 50, 60, 70.

In order to enable the moving arrangement to emerge partially, the first trolley 2 has two opposite sides, first front 2A and second rear 2B, which are opened and possibly closed by corresponding doors.

With particular reference to FIGS. 1 and 2, the apparatus 1 comprises a first moving arrangement 20 suitable for supporting and moving the operating unit 50 and are fixed to an upper portion of the supporting frame 25.

The first moving arrangement 20 comprises a first carriage 44 (FIGS. 2, 3, 4 and 5) that is slidable along a first longitudinal direction X on first guides 45 fixed to the frame 25, on opposite sides of the latter. In particular, the first carriage 44 comprises two first sliding blocks 64 connected by first cross bars 65 and provided with first wheels 66 arranged for engaging said first guides 45.

On the first cross bars 65 there is slidably mounted a first slide element 46 comprising a pair of first carriages 47 provided with respective wheels 47*a*, that are slidable on said first cross bars 65, along a second transverse direction Y, substantially orthogonal to said first direction X.

To the first slide element 46 there is fixed a first gripping arrangement 40, consisting of a pair of L-shaped elongated arms 40*a*, 40*b*, each of which is connected to a respective first carriage 47 and is suitable for supporting a corresponding part 50A, 50B of the operating unit 50.

The free end of each elongated arm 40*a*, 40*b* has housings 40*c* suitable for receiving respective first supporting portions 51 of the operating unit 50. In particular, the arm has two open slots suitable for engaging respective supporting pins 51 of the operating unit 50.

If the element 50 is a single body, the first slide element 46 may comprise a single first carriage 47 supporting a corresponding elongated arm 40.

In an embodiment that is not shown of the apparatus 1, the first gripping arrangement 40 is slidably connected to the first slide element 46 in such a way as to be able to slide according to a third direction Z that is substantially orthogonal to the first direction X and to the second direction Y.

The first moving arrangement 20 is driven manually by one or more operators through mechanisms and controls, which are of known type and are not shown, that act on the first carriage 44 and on the first slide element 46. These latter slide element 46 may comprise, for example, lead nuts or nut screws coupled with respective screws, rotated manually by handwheels or cranks. Instead of the latter, a portable driving device can be used, for example electric screwdrivers.

Figure 5:
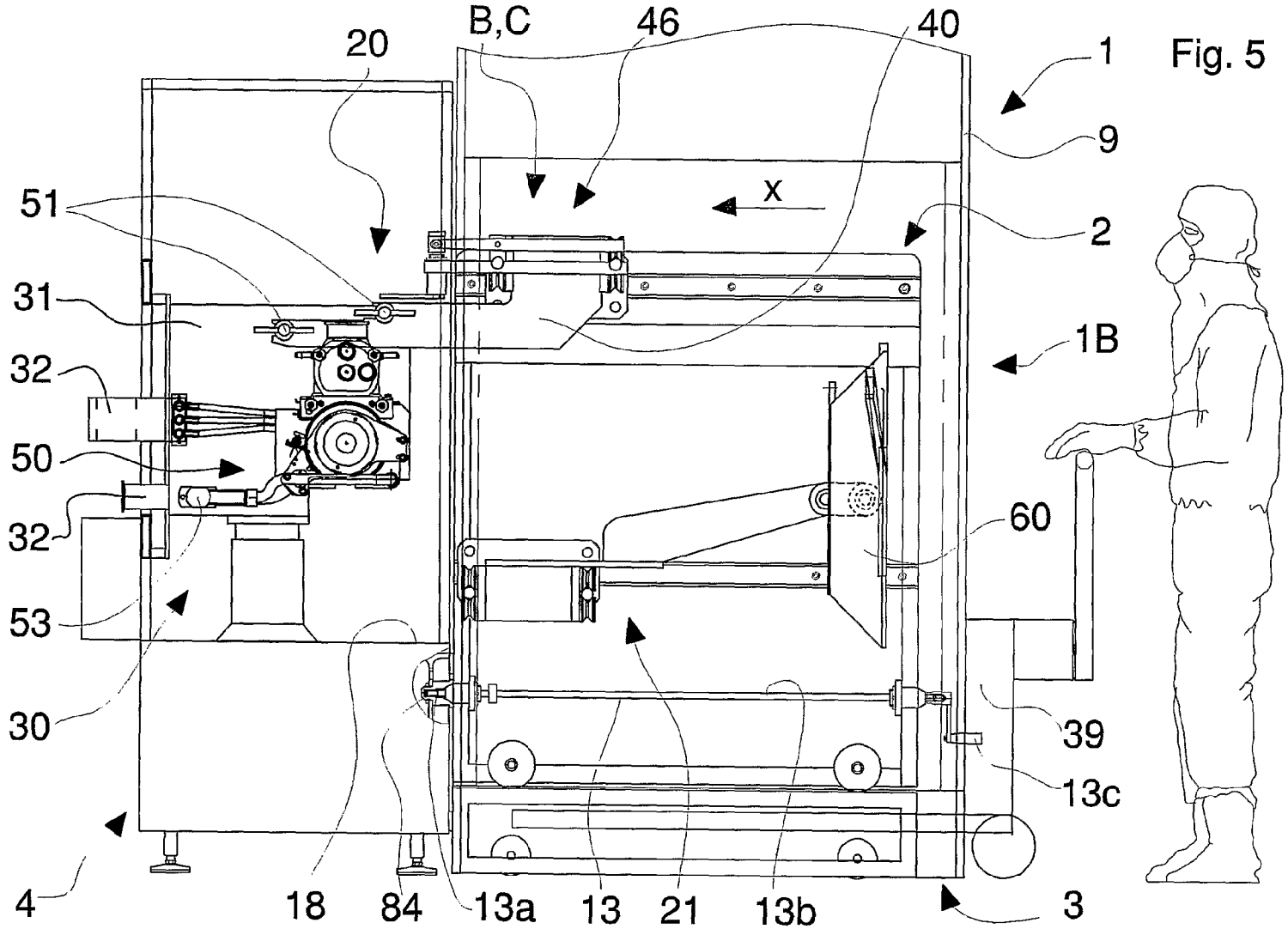
FIG. 5 is a schematic and fragmentary side view of the apparatus in FIG. 1 in association with a packaging operating machine, showing a first moving arrangement of the first element in an operating position.

According to what has been illustrated in FIGS. 1, 2 and 5, a second moving arrangement 21 is provided per supporting and moving the second element 60. This second moving arrangement 21 comprises a second carriage 48 slidable along the first direction X on second guides 49 fixed to the frame 25 on opposite sides of the latter, below the first moving arrangement 20. In particular, the second carriage 48 comprises two second sliding blocks 67 connected by second cross bars 68 and provided with respective wheels 69 arranged for engaging said second guides 49.

On said second cross bars 68 there is slidably mounted a second slide element 54 (FIG. 2) that supports a second gripping arrangement 41, consisting of an articulated elongated arm, the free end of which is configured for hooking and supporting said second element 60.

According to what has been illustrated in FIGS. 1 and 2, the second slide element 54 substantially comprises a carriage, provided with respective wheels 72, that slide on said second cross bars 68, along the second direction Y. To the carriage there is fixed a respective plate 73 to which the articulated arm 41 is connected.

This latter arm 41 (FIG. 6) comprises a first elongated portion 41*a* to the free end of which there is fixed a second portion 41*b* configured for engaging with a second supporting portion 61 of the second element 60. The second portion 41*b* can be rotated by respective driving members, for example manual control driving members.

The second moving arrangement 21 is driven manually through mechanisms and controls, which are of known type and are not shown, that act on the second carriage 48 and on the second slide element 54.

With reference to FIGS. 3 and 4, the apparatus 1 further comprises a third moving arrangement 22 suitable for supporting and moving the supply pipe 70.

The third moving arrangement 22 comprises a third carriage 55 slidable along the first direction X on third guides 56 fixed to the frame 25, on opposite sides of the latter, below the second moving arrangement 21. In particular, the third carriage 55 comprises a pair of third sliding blocks 74 (FIG. 4) connected by third cross bars 75 and provided with respective wheels 76 arranged for engaging with said third guides 56.

On said third cross bars 75 there is slidably mounted a third slide element 57 that supports a third gripping arrangement 42, comprising a pair of elongated supports 42*a*, 42*b* suitable for supporting the supply pipe 70.

The third slide element 57 substantially comprises a carriage, provided with respective wheels 77, that slide on said third cross bars 75, along the second direction Y.

The carriage is provided with a respective plate 78 to which are fixed the two elongated supports 42*a*, 42*b*. Each of said supports has seats 42*c* suitable for housing third supporting portions 71 of the supply pipe 70, consisting, for example, in two or more supporting pins.

Also the third moving arrangement 22 is driven manually by means of respective mechanisms and controls, which are of known type and are not shown, that act on the third carriage 55 and on the third slide element 57.

The manual drive or by means of portable driving device, and the absence of electric or pneumatic motors and actuators on the apparatus 1 is due to the fact that the latter has to be washable and above all sterilisable in an autoclave. Normal electric motors and actuators and the corresponding control and management systems are in fact not able to withstand the high temperatures necessary for correct sterilisation.

For this purpose the first trolley 2 are made of materials that are suitable to washing and sterilisation, for example stainless steel, silicone rubber, etc.

It is provided for that the elements 50, 60, 70 before being introduced into the sterile processing chamber, are sterilised together with the first trolley 2 inside a suitable autoclave, provided with two hatches, respectively in communication with the non-sterile external environment and with said chamber.

In an embodiment that is not shown of the apparatus 1, the moving arrangement 20, 21, 22 can be driven by respective motors and/or actuators that are removably mounted on said first trolley 2, in such a way as to be able to be dismantled during the washing and sterilising steps. Alternatively, the motor and/or an actuator device can be arranged for resisting washing agents and sterilising temperatures.

According to what has been illustrated in FIGS. 1 to 4, the apparatus 1 further comprises a second trolley 3 arranged for housing, supporting and moving the first trolley 2 and then the elements 50, 60, 70 contained therein, for example within a sterile atmosphere processing chamber.

In particular, the second trolley 3 has an upper supporting plane 27 on which there are fixed rails 38 suitable for slidably receiving wheels 26 of a frame 25, for maintaining the first trolley 2 separated and distant from the floor of the cleanroom. In fact, although the atmosphere within the latter is sterile, with a contamination class that is suitable for the type of process to be carried out, the floor of said chamber can be considered to be of a contamination class that is less or coarser as thereupon, or near it, by virtue of the one-way vertical air flow, the polluting solid particles remain confined that are possibly present in the chamber.

The second trolley 3 of the apparatus 1 thus prevents the frame 25, exiting the autoclave, from coming into direct contact with the aforesaid floor, so as to compromise the sterility of the first trolley 2 and, above all of the elements 50, 60, 70 that it contains and conveys.

The supporting plane 27 of the second trolley 3 is arranged at the same level or height as the bottom surface of the autoclave.

According to what has been shown in FIG. 1, a removing arrangement 19, fixed to the second trolley 3, is provided for hooking the first trolley 2 and dragging it onto and/or pushing it outside said second trolley 3.

The removing arrangement 19 comprises, for example, an extendible telescopic or pantograph arm that can be lengthened and shortened and is provided with a free end suitable for grasping a portion of the supporting frame 25. The removing arrangement 19 can be driven manually by means of a crank or a handwheel or by using an electric screwdriver.

The aforesaid second trolley 3 is further provided with a containing element 9 (FIGS. 1, 3 and 5) suitable for providing a cover structure for entirely enclosing the first trolley 2. The containing element 9 is substantially box-shaped and comprises two closed side walls, for example by transparent panels, the remaining two opposite walls being provided with respective first 16 and second 24 hatches for the entering and the exiting of the first trolley 2.

A conditioning device 10 is provided in the upper portion of the containing element 9 to generate a one-way air flow that is almost vertical and directed from top to bottom.

According to what has been illustrated in FIG. 1, the conditioning device 10 comprises one or more fans or blowers 28 that is able to suck air from the processing chamber and direct it through a filtering arrangement 29, for example HEPA type absolute filters, to the first trolley 2 and to the elements 50, 60, 70.

Figure 7:
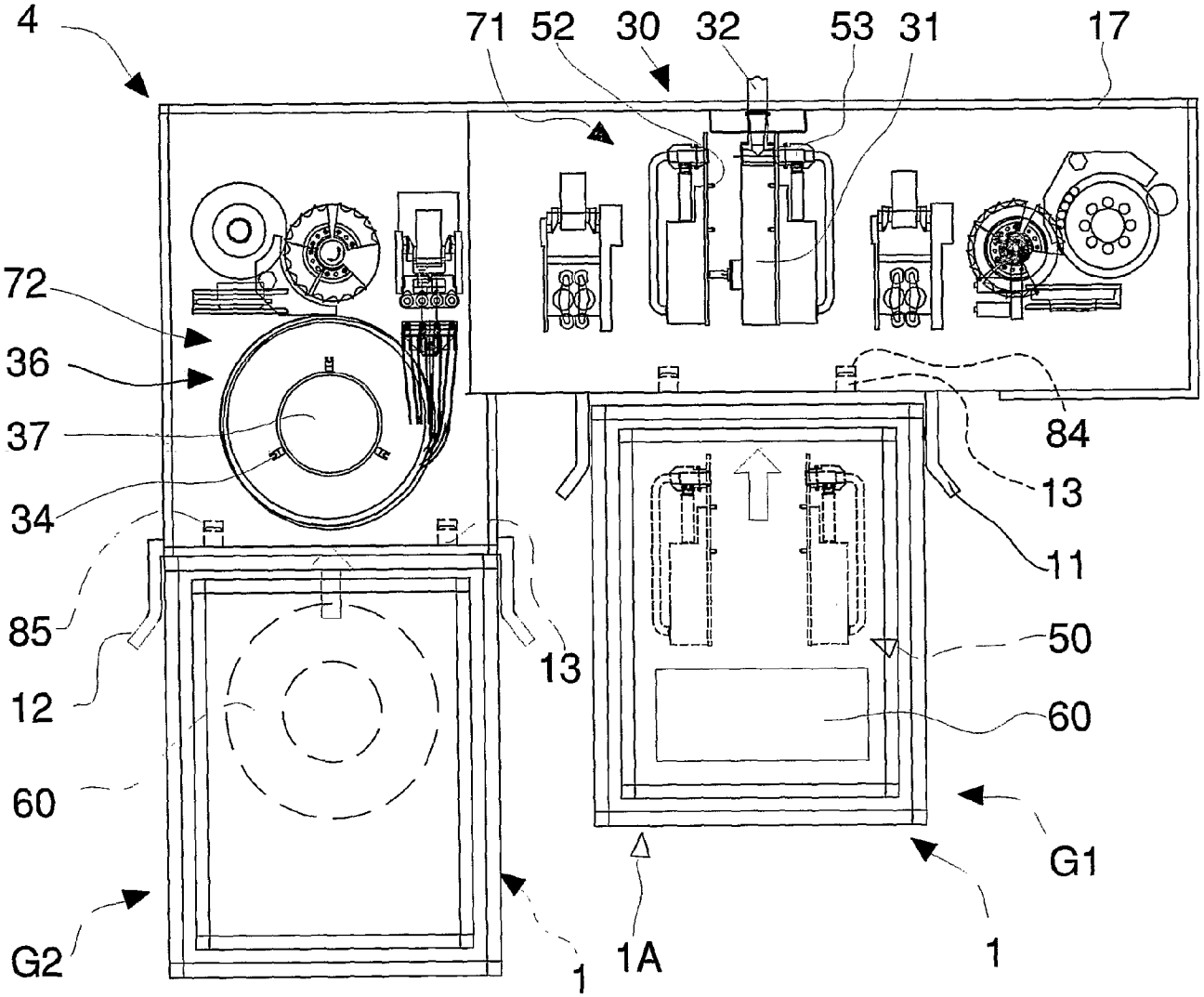
FIG. 7 is a schematic plan view of the apparatus in FIG. 1 in association with a packaging operating machine, showing said apparatus in two hooking positions of hooking to said machine.
Figure 8:
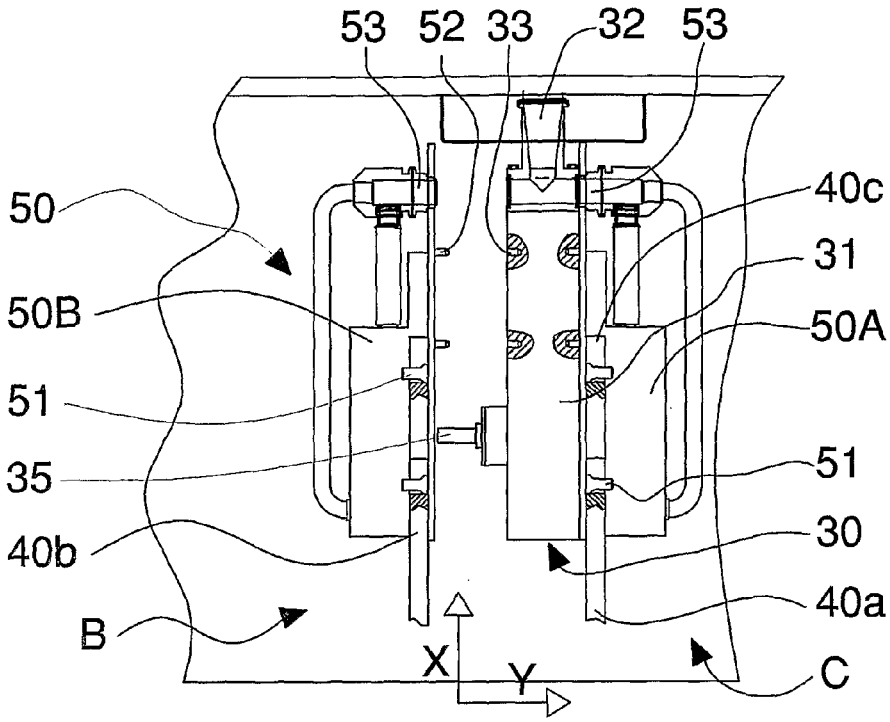
FIG. 8 is a fragmentary enlarged view of a detail in FIG. 7, showing a first element associated with a first supporting arrangement of the operating machine.

As shown in particular in FIG. 5 and in FIG. 7 respectively, the transferring apparatus 1 can be moved manually by an operator who pushes it from a side 1B that is behind and opposite a front side 1A through which the first trolley 2 enters inside the second trolley 3 and coinciding with the side of the containing element 9 in which there is positioned the first access hatch 16.

In order to facilitate the movement of the second trolley 3 there can be provided the use of a possibly motor-driven transpallet 39 (FIG. 5) that is able to lift and move the entire apparatus 1.

In an embodiment that is not shown, it is also provided that the second trolley 3 is provided with a driving device and with a controlling device configured for moving said second trolley 3 independently and automatically, without the assistance of operators, according to set trajectories and paths. The second trolley 3 may comprise, for example, an AGV (Automated Guided Vehicle) unit of known type that is movable along magnetic tracks obtained in the floor of the processing chamber or guided by radio or GPS navigation systems.

The apparatus 1 is further provided with a joining arrangement 13 arranged for locking said apparatus 1 to the packaging machine 4 in different hooking positions G1, G2, to enable elements 50, 60, 70 (FIGS. 5-7) to be transferred and/or removed.

In particular, the joining arrangement 13 is configured for engaging with attaching arrangement 84, 85 provided in a lower front version of said machine 4.

Figure 6:
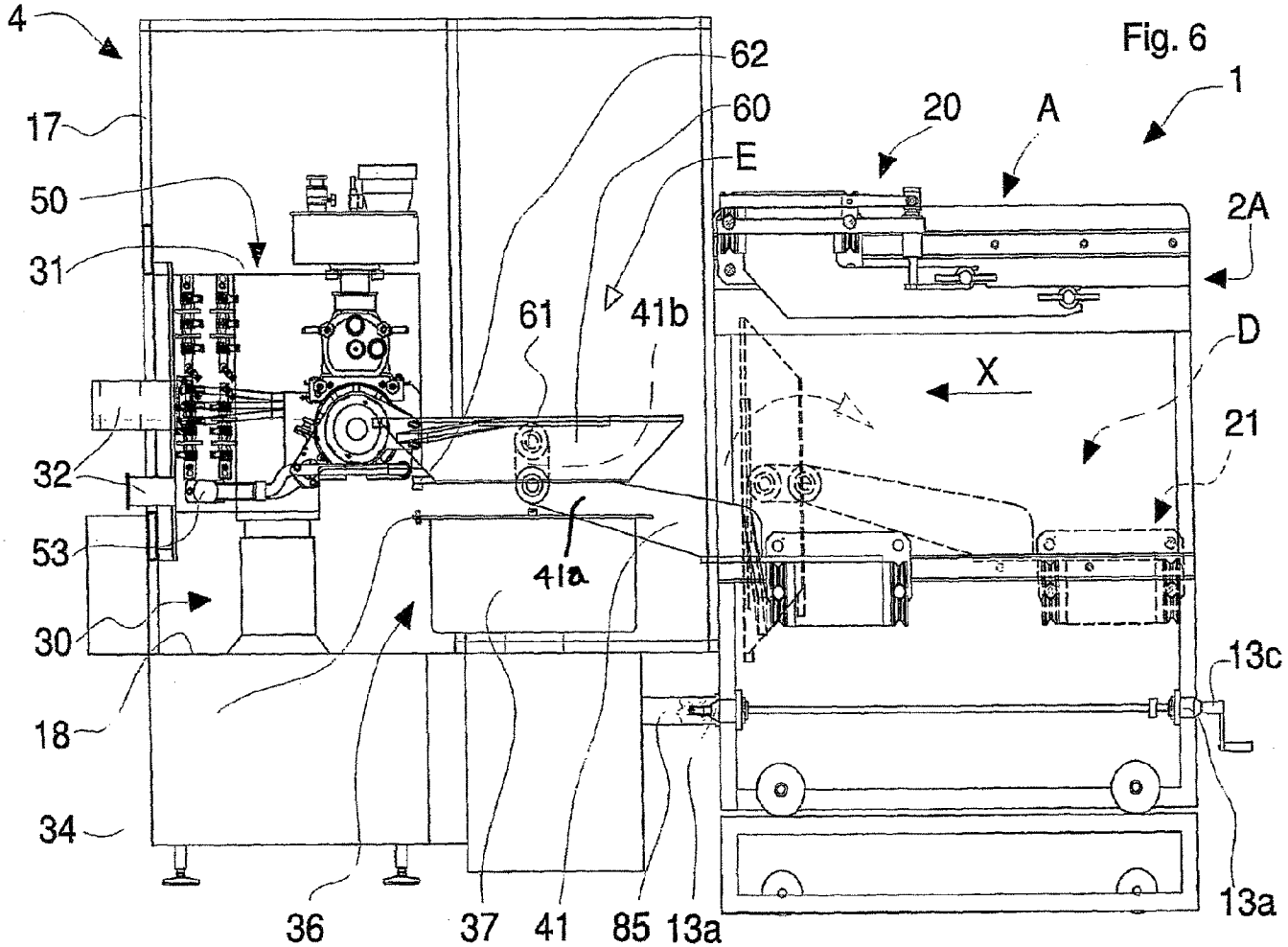
FIG. 6 is a schematic and fragmentary side view of the apparatus in FIG. 1 in association with a packaging operating machine, showing a second moving arrangement of the second element in an operating position.

According to what has been illustrated in FIGS. 1 and 6, the joining arrangement 13 comprises, for example, a pair of threaded pins 13*a* that are rotatably connected to the supporting frame 25, respectively at the first front side 2A and at the second rear side 2B of the first trolley 2, said pins being connected together by a rod 13*b*.

Each of the two threaded pins 13*a* is arranged for being inserted and screwed into respective threaded seats of the attaching arrangement 84, 85 of the machine 4 or for being removably coupled with a driving crank or handwheel 13*c*, for rotating the rod 13*b*. In this way, the joining arrangement 13 enables the first trolley 2, i.e. the apparatus 1, to be fixed to the packaging machine 4 on both the front 2A and rear 2B sides of said first trolley 2.

The joining arrangement 13, i.e. the pins 13*a* can be rotated manually by the operator using the cranks 13*c* or by a portable driving device, for example electric screwdrivers coupled with the threaded pins that are not engaged in the attaching arrangement.

In an embodiment that is not shown of the apparatus 1, the joining arrangement 13 is fixed to the second trolley 3 to lock these latter on the machine 4. In this case, the removing arrangement 19 keeps the first trolley 2 fixed to the second trolley 3. The packaging machine 4 comprises a supporting arrangement that enables the elements conveyed by the transferring apparatus 1 to be mounted and/or dismantled.

In particular, as better illustrated in FIGS. 5 to 8, the machine comprises, for example, a first supporting arrangement 30 and a second supporting arrangement 36 suitable for receiving and supporting respectively the first element 50 and the second element 60.

The first supporting arrangement 30 comprises a first supporting element 31 fixed to a horizontal plane 18 of the machine 4 and provided with first hooking elements 33 (FIG. 8) suitable for abutting and locking abutting elements 52 provided in the operating unit 50.

The hooking elements 33 are, for example, shaped seats arranged for receiving abutting elements 52 in the form of respective locking pins.

The first supporting arrangement 30 further comprises connecting device 32, configured for engaging respective connectors 53 of the operating unit 50 and thus connecting the latter to a pneumatic circuit and/or product supply circuit of the packaging machine 4.

Mechanical coupling member 35 is provided on the first supporting element 31, to kinetically connect mechanical devices of the operating unit 50 to a motor of the packaging machine 4.

The second supporting arrangement 36 comprises a second supporting element 37 which is also fixed to the horizontal plane 18 of the machine 4 and is provided with second hooking elements 34 that is suitable for abutting and locking second abutting elements 62 provided in the vibrating supply device 60.

The packaging machine 4 further comprises a centring arrangement 11, 12 that enables the apparatus 1 to be arranged with precision in one or more hooking positions.

The hooking positions are for example two (FIG. 7) and correspond to respective specific operating zones of the machine 4. A first hooking position G1 corresponds to a first operating zone 71, in which the first element 50 has to be assembled; a second hooking position G2 corresponds to a second operating zone 72, in which the second element 60 has to be mounted.

According to what has been shown in FIG. 7, the centring arrangement may comprise, for example, one or more pairs of prongs or elongated elements, typically a first pairs of prongs 11 and a second pair of prongs 12, each of which is fixed orthogonally to a front portion of the machine 4, at the respective operating zone 71, 72.

The prongs of each pair 11, 12 are spaced apart from one another and divergent to the exterior of the machine 4 in such a way as to abut, for example, lower side walls of the second trolley 3 for guiding and progressively centring the apparatus 1, which is pushed to the machine 4, to a defined respective hooking position G1, G2.

At the centring arrangement 11, 12 there is positioned the aforesaid attaching arrangement 84, 85. In particular, a first attaching arrangement 84 is associated with the first pair of prongs 11 and a second attaching arrangement 85 associated with the second pair of prongs 12.

Figure 9:
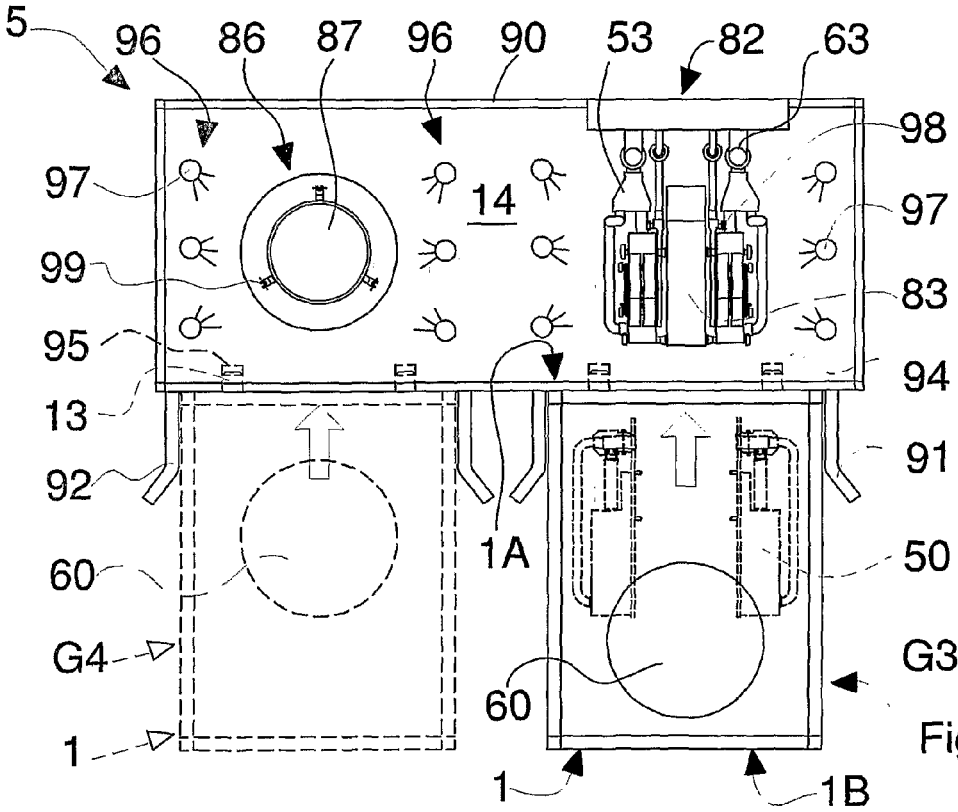
FIG. 9 is a schematic plan view of the apparatus in FIG. 1 in association with an operating washing machine, in which said apparatus is in two hooking positions hooked to said machine.

As shown in FIG. 9, it is provided for that the transferring apparatus 1 can interact with an operating washing machine 5, arranged for washing internally and/or externally elements of the packaging machine 4 that have come into contact with the product.

The washing machine 5 may, for example, be positioned inside the service room adjacent to and communicating with the processing chamber.

Similarly to what occurs with the packaging machine 4, the transferring apparatus 1 can be located with respect to the washing machine 5 in different hooking positions. For this purpose, the washing machine 5 comprises respective centring arrangement 91, 92 that is substantially identical to the centring arrangement 11, 12 of the packaging machine 4.

In each hooking position, the apparatus 1 is removably locked on the washing machine 5 owing to the joining arrangement 13 arranged for engaging with respective attaching arrangement 94, 95 provided on a front portion of said washing machine 5, at the centring arrangement 91, 92.

The attaching arrangement 94, 95 of the washing machine 5 is identical to the attaching arrangement 84, 85 of the packaging machine 4.

The hooking positions of the transferring apparatus 1 to the washing machine 5 may, for example, be two: a third connecting position G3 for transferring the first element 50 to the washing machine 5, and a fourth connecting position G4 for transferring the second element 60.

The washing machine 5 includes a protecting cover 90, which is provided with one or more doors and defines an internal washing space 14.

The washing machine 5 comprises further respective supporting arrangement 82, 86 that is substantially similar to the supporting arrangement 30, 36 of the packaging machine 4 and is configured for enabling elements to be mounted and dismantled.

The respective supporting arrangement 82, 86 comprises respective supporting elements 83, 87 fixed to a plane of the washing machine 5 and provided with respective hooking elements 98, 99 suitable for hooking and supporting the elements 50, 60.

The respective supporting arrangement 82, 86 may comprise fixtures and connections suitable for conveying washing fluids inside the elements 50, 60.

Still with particular reference to FIG. 9, the washing machine 5 is arranged, for example, for receiving and operating on the first element 50, and which can be fixed to a third supporting arrangement 82, and to the second element 60, which on the other hand can be fixed to a fourth supporting arrangement 86.

The first element 50 is the dosing unit that is fixed to the third supporting arrangement 82 in such a way that respective further connecting arrangement 63 of the washing machine 5 is connected to the respective connectors 53 of the operating unit 50, to deliver to conduits, pipes and internal passages of the latter suitable washing fluids.

The washing machine 5 is further provided with a dispensing device 96, arranged in the internal space 14 for washing the external surfaces of the elements 50, 60. The dispensing device 96 comprises, for example, a plurality of sprayers or nozzles 97 that are suitably distributed spaced apart from one another in the internal space 14.

The operation of the transferring apparatus 1 provides a sequence of operating steps for transferring and/or mounting elements 50, 60, 70 on the packaging machine 4, and a sequence of operating steps for, on the other hand, removing and/or dismantling said elements from the packaging machine, for example at the end of production.

Substantially identical operating steps are applied during transferring and removal of the elements on the washing machine 5.

In the transferring procedure, the elements 50, 60, 70 have to be mounted and assembled on the packaging machine 4, placed inside a sterile atmosphere processing chamber.

The elements 50, 60, 70, which have been previously washed and positioned on the first trolley 2 of the apparatus 1, for example in the service room, are sterilised together with the aforesaid first trolley 2 inside a suitable autoclave.

At the end of the sterilising step, an operator opens the internal hatch of the autoclave communicating with the processing chamber, and positions the second trolley 3, with the first access hatch 16 open for receiving the first trolley 2. The operator acts on the removing arrangement 19 that hooks and drags the first trolley 2 inside the second trolley 3.

The conditioning device 10 of the second trolley 3 is operational for directing a vertical one-way air flow downwards onto the elements and to maintain the atmosphere inside the containing element 9 of the apparatus 1 in slight pressure with respect to the processing chamber, in order to prevent the entry of possible contaminating particles.

When one of the movable hatches 16, 24 of the containing element 9 is open, the operator acts on the second trolley 3, for example to drive the removing arrangement 19, always being arranged on the side opposite said open hatch, in such a way that possible polluting particles released thereby do not penetrate inside the containing element.

Before making the apparatus 1 approach the packaging machine 4, the operator, positioned on the rear side 1B of the apparatus, opens the first access hatch 16 of the containing element 9, the doors of a cover structure 17 (FIG. 7) of the machine 4 having been previously opened.

If the operating unit 50 has to be mounted on the packaging machine 4 the operator makes the apparatus 1 approach in such a way that the first centring arrangement 11 precisely positions said apparatus 1 at the first operating zone 71 of the packaging machine 4, the first trolley 2 abutting the latter with the first front side 2A.

After positioning has been carried out, the operator can drive the joining arrangement 13 in such a way as to lock the apparatus 1 in the first hooking position G1.

It is then possible to drive the first moving arrangement 20 to position the operating unit 50 on the first supporting arrangement 30.

In particular, starting from a first operating position A (FIG. 1), in which the first moving arrangement 20 is arranged completely inside the apparatus 1, the first carriage 44 is moved along the first longitudinal direction X in a second operating position B (FIG. 5), in which the first gripping arrangement 40 positions the two parts 50A, 50B of the operating unit 50 at the sides of the first supporting element 31 of the first supporting arrangement 30 of the packaging machine 4.

Subsequent driving of the first slide elements 46 in a third operating position C (FIGS. 5 and 8), enables the two parts 50A, 50B to be hooked to the first supporting element 31.

In particular, the two first carriages 47 of the first slide elements 46 are driven, simultaneously or in sequence, along the second transverse direction Y, to permit translation of the respective elongated arms 40*a*, 40*b* that support the two parts 50A, 50B of the operating unit 50. In this way, the locking pins 52 of the two parts 50A, 50B are inserted into the respective shaped seats 33 of the first supporting element 31, the connecting device 32 of the first supporting arrangement 30 is connected to the respective connectors 53 of the operating unit 50, and the coupling member 35 of the first supporting element 31 is connected to the mechanical devices of the operating unit 50.

Manually or automatically drivable arresting device removably locks the operating unit 50 on the first supporting arrangement 30. This arresting device, which is of known type and is not shown, comprises for example one or more threaded fixing knobs.

The operating unit 50 is then mounted on the packaging machine 4 and is ready for operation.

The first moving arrangement 20 of the apparatus 1 is then disengaged from the operating unit 50 and returned to the first operating position A. The transferring apparatus 1 can be released from the packaging machine 4 thus disengaging the joining arrangement 13 from the first attaching arrangement 84.

At this point the apparatus 1 can be removed from the packaging machine 4.

If the operating unit 50 has to be dismantled and removed from the packaging machine 4 the operating steps disclosed for mounting are repeated in reverse order. In this case, the first moving arrangement 20 hooks and then removes the operating unit 50 from the first supporting arrangement 30.

For the mounting of the second element 60—the vibrating supply device for caps—the apparatus 1 is moved to the second operating zone 72 of the packaging machine 4. Owing to the structure of the second moving arrangement 21, the apparatus 1 is made to approach the packaging machine 4 in such a way that it is the second rear side 2B of the first trolley 2 that abuts on said machine. For this purpose, the operator is positioned on the front side 1A of the apparatus 1, and it is the second access hatch 24 of the containing element 9 that is opened.

The operator makes the apparatus 1 approach in such a way that the second centring arrangement 12 precisely places said apparatus 1 at the second operating zone 72 of the packaging machine 4.

After positioning, the operator can drive the joining arrangement 13 that engages the second attaching arrangement 85 in such a way as to lock in the second hooking position G2 the apparatus 1 (FIG. 6).

It is then possible to drive the second moving arrangement 21 to place the second element 60 on the second supporting arrangement 36 of the packaging machine 4. In particular, from a respective first operating position D (FIG. 6), in which the second moving arrangement 21 and the second element 60 are arranged completely inside the apparatus 1, the second carriage 48 is moved along the first longitudinal direction X to a respective second operating position E (FIG. 6), in which the second gripping arrangement 41 protruding from the apparatus 1 is driven to rotate and to position said second element 60 on the second supporting element 37 of the second supporting arrangement 36. The second portion 41*b*, fixed on the first portion 41*a* of the second gripping arrangement 41, is rotated by approximately 90° clockwise and possibly translated vertically, to arrange the second element 60 in such a way that the second abutting elements 62 of the latter engages the hooking elements 34 of the second supporting arrangement 36. At this point the gripping arrangement 41 is disengaged from the second supporting portion 61 of the second element 60, and the second moving arrangement 21 is returned to the respective first operating position D.

The transferring apparatus 1 can then be released from the packaging machine 4 disengaging the joining arrangement 13 from the second attaching arrangement 85 and distanced from the packaging machine 4.

If the second element 60 has to be dismantled and removed from the packaging machine 4 the operating steps disclosed for mounting are repeated in reverse order.

For transferring the third element 70—the supply pipe—the apparatus 1 is moved, for example, to the first operating zone 71 of the packaging machine 4 and made to approach the first centring arrangement 11, the first trolley 2 abutting on the packaging machine 4 with the first front side 2A.

After positioning, the operator can drive the joining arrangement 13 that engages with the first attaching arrangement 84 in such a way as to lock the apparatus 1 in the first hooking position G1.

It is then possible to drive the third moving arrangement 22 to transfer the supply pipe 70 inside the packaging machine 4.

In particular, from a respective first operating position F, in which the second moving arrangement 22 is arranged completely inside the transferring apparatus 1, the third carriage 55 is moved along the first longitudinal direction X inside the packaging machine 4. Subsequent driving of the third slide elements 57 enables the supply pipe 70 to be positioned at removing arrangement of the packaging machine, which are of known type and are not shown, which removes from the third gripping arrangement 42 of the third slide elements 57 the supply pipe 70 and in case fix it to the packaging machine 4 in the required position.

When the third gripping arrangement 42 is disengaged from the third supporting portion 71 of the supply pipe 70, the third moving arrangement 22 is returned to the respective first operating position F (FIG. 3).

The transferring apparatus 1 can then be released from the packaging machine 4, disengaging the joining arrangement 13 from the first attaching arrangement 84 and distanced from the packaging machine 4.

If the supply pipe 70 has to be removed from the packaging machine 4 the operating steps disclosed for transferring are repeated in reverse order.

The same sequence of steps that is necessary for mounting and dismantling the first element 50 and the second element onto or from the packaging machine 4 can be repeated for the washing machine 5.

If the apparatus 1 comprises the second trolley 3, the corresponding containing element 9 prevents contact of the operator with the conveyed elements 50, 60, 70 that are contaminated with product.

If the apparatus 1 is used without the second trolley 3, it is advisable for the operator to interact with the apparatus 1, placing himself on the opposite side or behind the movement direction to prevent himself from coming into contact with residual product that is possibly present on the elements 50, 60, 70.

Now with reference to FIG. 9, the apparatus 1, devoid of the second trolley 3, is abutted on the washing machine 5 removably locked in relation thereto in one of the two connecting positions G3, G4.

In the third hooking position G3, the first moving arrangement 20 transfers and mounts the operating unit 50 on the third supporting arrangement 82 of the washing machine 5, in such a way that the first abutting elements 52 of the operating unit 50 engages respective hooking element 98 of the third supporting arrangement 82. In addition thereto, mounting enables further connecting arrangement 63 of the washing machine 5 to be connected to respective connectors 53 of the operating unit 50, to deliver suitable washing fluids to conduits, pipes and internal passages of the latter.

In the fourth hooking position G4 the second moving arrangement 21 transfers and mounts the second element 60 on the fourth supporting arrangement 86, in such a way that the second abutting elements 62 of said second element 60 engages with respective hooking element 99 of the fourth supporting arrangement 86.

As the second element 60 is not provided with conduits and internal passages, the presence on the fourth supporting arrangement 86 of specific connections and fixtures for dispensing washing fluids is not requested.

The washing machine 5 can be configured in function of the elements to be washed and thus comprise further supporting arrangement suitably arranged for receiving and supporting respective elements, provided or not with connections and fixtures for internal washing.

At the end of the elements 50, 60 washing procedure, it is possible to remove said elements using the transferring apparatus 1, repeating in reverse order the operating steps disclosed for mounting. In this case, the moving arrangement 21, 22 will hook and then remove the elements 50, 60 from the supporting arrangement 82, 86.

It should be noted that the apparatus that is the object of the present invention enables elements of an operating machine to be transferred and moved, without the direct manual intervention on said elements by operators being required.

This is particularly important both in the mounting step to prevent possible particular contamination of the washed and sterilised elements, and during the dismantling step to prevent the operator from coming into contact with the packaged product.

In the various operating steps disclosed above the apparatus 1 is moved and the various operating arrangement, i.e. the moving arrangement 20, 21, 22, of the removing arrangement 19, and of the joining arrangement 13 are driven manually by one or more operators.

There can also be provided motors and driving device and corresponding management and control device, that are of known type and are not shown, that are arranged for moving the transferring apparatus and driving the various operating arrangement independently and automatically, without the direct intervention of operators.

If the operating machine is a packaging machine 4 arranged for operating within a sterile atmosphere processing chamber, for example for packaging drugs, the aforesaid embodiment of the apparatus 1 enables all the aforesaid operating procedures to be performed automatically without the presence of operators inside said chamber being required.

The invention claimed is:

1. Apparatus for housing, transferring and moving elements that are removably associable with an operating machine comprising: a moving arrangement that is suitable for receiving and supporting said elements, said moving arrangement being movable for transferring to and/or removing from said operating machine said elements, a first trolley provided with a supporting frame provided with wheels and suitable for slidably supporting said moving arrangement, and a second trolley suitable for housing, supporting and moving said first trolley and said elements contained therein, wherein said second trolley comprises an upper supporting plane provided with rails suitable for receiving said wheels of said first trolley, wherein said second trolley is further provided with a containing element providing a cover structure arranged for entirely enclosing and housing said first trolley, wherein a moving structure is co-operable with said second trolley, and said cover structure and said second trolley are moved integrally by the moving structure, and wherein said second trolley comprises a conditioning device arranged in an upper portion of said containing element and suitable for generating an air flow inside said containing element.

2. Apparatus according to claim 1, wherein said moving arrangement comprises a respective gripping arrangement arranged for abutting supporting portions of said elements.

3. Apparatus according to claim 1, wherein said moving arrangement is movable between respective first operating positions, wherein it is arranged inside said apparatus and respective second operating positions wherein it partially protrudes from said apparatus for removing and/or transferring elements.

4. Apparatus according to claim 1, wherein said moving arrangement is drivable manually.

5. Apparatus according to claim 1, comprising an actuating device for driving said moving arrangement.

6. Apparatus according to claim 1, wherein said containing element comprises a first access hatch and a second access hatch.

7. Apparatus according to claim 1, wherein said conditioning device comprises a fan and a filtering arrangement.

8. Apparatus according to claim 1, wherein said second trolley is movable manually or by means of a driven carriage.

9. Apparatus according to claim 1, wherein said second trolley comprises a driving device and control device suitable for automatically moving said second trolley along set trajectories and paths.

10. Apparatus according to claim 1, wherein said second trolley comprises a removing arrangement suitable for hooking and locking said first trolley, said removing arrangement being movable for introducing into and/or ejecting from said second trolley said first trolley.

11. Apparatus according to claim 10, wherein said removing arrangement comprises an extendible arm provided with an end suitable for grasping a portion of said first trolley.

12. Apparatus according to claim 10, wherein said removing arrangement is drivable manually.

13. Apparatus according to claim 1, comprising a joining arrangement suitable for removably fixing said apparatus to said operating machine in a hooking position.

14. Apparatus according to claim 13, wherein said joining arrangement is configured for engaging an attaching arrangement of said operating machine.

15. Apparatus according to claim 13, wherein said joining arrangement is associated with said first trolley or with said second trolley.

16. Apparatus according to claim 13, wherein said joining arrangement is drivable manually.

17. Apparatus according to claim 13, wherein said joining arrangement comprises at least a threaded pin rotatably mounted and arranged for being inserted and tightened in a threaded seat of said operating machine.

18. Apparatus according to claim 13, comprising a first trolley provided with a supporting frame provided with wheels and suitable for slidably supporting said moving arrangement, wherein at least said first trolley, said moving arrangement, and said joining arrangement are sterilisable in an autoclave.

19. Apparatus according to claim 1, comprising a first moving arrangement provided with first carriage movable on first guides and slidably supporting a first slide element associated with a first gripping arrangement.

20. Apparatus according to claim 19, wherein said first carriage is movable along a first longitudinal direction, said first slide element being movable along a second transverse direction, substantially orthogonal to said first longitudinal direction.

21. Apparatus according to claim 19, comprising a first trolley provided with a supporting frame provided with wheels and suitable for slidably supporting said moving arrangement, wherein said first guides are fixed to said supporting frame.

22. Apparatus according to claim 19, wherein said first slide element comprises at least a first carriage that is slidable on first cross bars of said first carriage.

23. Apparatus according to claim 19, wherein said gripping arrangement comprises at least an elongated arm fixed to said first carriage and suitable for supporting a first element.

24. Apparatus according to claim 23, wherein said elongated arm comprises housings arranged for receiving respective first supporting portions of said first element.

25. Apparatus according to claim 1, comprising a second moving arrangement provided with a second carriage movable on second guides and slidably supporting a second slide element bearing a second gripping arrangement.

26. Apparatus according to claim 25, comprising a first moving arrangement provided with first carriage movable on first guides and slidably supporting a first slide element associated with a first gripping arrangement, wherein said first carriage is movable along a first longitudinal direction, said first slide element being movable along a second transverse direction, substantially orthogonal to said first longitudinal direction and said second carriage is movable along said first longitudinal direction, said second slide element being movable along said second transverse direction.

27. Apparatus according to claim 25, comprising a first trolley provided with a supporting frame provided with wheels and suitable for slidably supporting said moving arrangement, wherein said second guides are fixed to said supporting frame.

28. Apparatus according to claim 25, wherein said second slide element comprises at least a carriage that is slidable on second cross bars of said second carriage.

29. Apparatus according to claim 25, wherein said second gripping arrangement comprises an articulated arm suitable for supporting a second element.

30. Apparatus according to claim 29, wherein said articulated arm comprises a first elongated portion having a free end, to the free end of which there is rotatably connected a second portion configured for receiving a second supporting portion of said second element.

31. Apparatus according to claim 1, comprising a third moving arrangement provided with a third carriage movable on third guides and slidably supporting a third slide element associated with a third gripping arrangement.

32. Apparatus according to claim 31, comprising a first moving arrangement provided with first carriage movable on first guides and slidably supporting a first slide element associated with a first gripping arrangement, wherein said first carriage is movable along a first longitudinal direction, said first slide element being movable along a second transverse direction, substantially orthogonal to said first longitudinal direction and said third carriage is movable along said first longitudinal direction, said third slide element being movable along said second transverse direction.

33. Apparatus according to claim 32, comprising a first trolley provided with a supporting frame provided with wheels and suitable for slidably supporting said moving arrangement, wherein said third guides are fixed to said supporting frame.

34. Apparatus according to claim 31, wherein said third slide element comprises at least a further carriage that is slidable on third cross bars of said third carriage.

35. Apparatus according to claim 31, wherein said third gripping arrangement comprises a pair of elongated supports suitable for supporting a third element.

36. Apparatus according to claim 35, wherein said elongated supports comprise respective seats suitable for receiving third supporting portions of said third element.

* * * * *